US012025333B1

(12) United States Patent
Thrift et al.

(10) Patent No.: US 12,025,333 B1
(45) **Date of Patent: *Jul. 2, 2024**

(54) SYSTEMS AND METHODS FOR COIL TEMPERATURE DEVIATION DETECTION FOR A CLIMATE CONTROL SYSTEM

(71) Applicant: Trane International Inc., Davidson, NC (US)

(72) Inventors: Jonathan Edward Thrift, Jacksonville, TX (US); Christopher Blake Smith, Whitehouse, TX (US); Dominique Ashley Schaefer Pipps, Tyler, TX (US)

(73) Assignee: Trane International Inc., Davidson, NC (US)

( * ) Notice: Subject to any disclaimer, the term of this patent is extended or adjusted under 35 U.S.C. 154(b) by 14 days.

This patent is subject to a terminal disclaimer.

(21) Appl. No.: 18/063,288

(22) Filed: Dec. 8, 2022

Related U.S. Application Data

(63) Continuation of application No. 16/590,043, filed on Oct. 1, 2019, now Pat. No. 11,549,715.

(51) Int. Cl.

| | |
|---|---|
| ***F24F 11/83*** | (2018.01) |
| ***F24F 110/10*** | (2018.01) |
| ***F24F 110/12*** | (2018.01) |
| ***F24F 110/20*** | (2018.01) |

(52) U.S. Cl.
CPC ..... *F24F 11/83* (2018.01); *F24F 2110/10* (2018.01); *F24F 2110/12* (2018.01); *F24F 2110/20* (2018.01); *F25B 2500/19* (2013.01); *F25B 2700/02* (2013.01); *F25B 2700/2117* (2013.01)

(58) Field of Classification Search
CPC .... F24F 11/83; F24F 2110/10; F24F 2110/12; F24F 2110/20; F25B 2500/19; F25B 2700/02; F25B 2700/2117
See application file for complete search history.

(56) References Cited

U.S. PATENT DOCUMENTS

| | | | |
|---|---|---|---|
| 4,319,461 | A | 3/1982 | Shaw |
| 4,958,052 | A | 9/1990 | Mahieu |
| 5,065,593 | A | 11/1991 | Dudley et al. |
| 3,269,921 | A | 8/1996 | Oglesby et al. |
| 7,739,882 | B2 | 6/2010 | Evans et al. |
| 7,895,850 | B2 | 3/2011 | Kitsch |
| 9,535,408 | B2 | 1/2017 | Lingrey et al. |
| 9,890,980 | B2 | 2/2018 | Peitz et al. |
| 2002/0197949 | A1 | 12/2002 | Kampf et al. |
| 2006/0035349 | A1 | 2/2006 | Hoshino et al. |
| 2006/0201168 | A1 | 9/2006 | Kates |
| 2009/0037142 | A1 | 2/2009 | Kates |
| 2011/0041539 | A1 | 2/2011 | Nylykke |
| 2011/0082651 | A1 | 4/2011 | Mowris |
| 2012/0271576 | A1 | 10/2012 | Kamel et al. |

(Continued)

FOREIGN PATENT DOCUMENTS

| | | | |
|---|---|---|---|
| CN | 109210699 | A | 1/2019 |

*Primary Examiner* — Henry T Crenshaw
(74) *Attorney, Agent, or Firm* — WOMBLE BOND DICKINSON (US) LLP

(57) ABSTRACT

Methods and related systems of detecting a temperature deviation in a heat exchanger coil of a climate control system are disclosed. In an embodiment, the method includes determining an enthalpy of the indoor space. In addition, the method includes detecting a coil temperature of the heat exchanger. Further, the method includes detecting a coil temperature deviation based on the enthalpy and the detected coil temperature.

20 Claims, 2 Drawing Sheets

(56) References Cited

U.S. PATENT DOCUMENTS

| | | | |
|---|---|---|---|
| 2013/0074537 | A1 | 3/2013 | Rollinger et al. |
| 2018/0112886 | A1 | 4/2018 | Boody |
| 2018/0113886 | A1 | 4/2018 | Brodt |
| 2018/0373278 | A1 | 12/2018 | Walser |

SYSTEMS AND METHODS FOR COIL TEMPERATURE DEVIATION DETECTION FOR A CLIMATE CONTROL SYSTEM

CROSS-REFERENCE TO RELATED APPLICATIONS

The present application is a continuation of U.S. patent application Ser. No. 16/590,043, filed Oct. 1, 2019, entitled Systems and Methods for Coil Temperature Deviation Detection for a Climate Control System, which is hereby incorporated by reference in its entirety.

STATEMENT REGARDING FEDERALLY SPONSORED RESEARCH OR DEVELOPMENT

Not applicable.

BACKGROUND

The climate of an indoor space (e.g., such as a residential home, office space, storage unit, etc.) may be controlled by a climate control system, such as a heating, ventilation, and air conditioning (HVAC) system, a refrigerant system, a de-humidification system, etc. When such systems are used to cool an indoor space, air is flowed through a heat exchanger that is circulating a refrigerant therethrough. The air exchanges heat with the refrigerant to lower a temperature thereof, and then the cooled air is circulated through the indoor space. In some circumstances, a temperature of a heat exchanger coil within such a climate control system may deviate from an expected to desired value. In the case of a climate control system operating to cool an indoor space, such a coil temperature deviation may correspond with a temperature of the heat exchanger coil dropping below an expected or designed value. This may lead to ice formation on the heat exchanger coils, which reduces a cooling performance of the climate control system and can cause damage to one or more components thereof (e.g., such as a refrigerant compressor).

BRIEF SUMMARY

Some embodiments disclosed herein are directed to a climate control system for an indoor space. In an embodiment, the climate control system includes a heat exchanger including a coil to flow refrigerant therethrough. In addition, the climate control system includes a coil temperature sensor configured to detect temperature of the coil. Further, the climate control system includes a controller to be coupled to the coil temperature sensor. The controller is configured to detect a coil temperature deviation based on an enthalpy of the indoor space and the temperature of the coil detected by the coil temperature sensor.

Other embodiments disclosed herein are directed to a method of detecting a temperature deviation in a heat exchanger coil of a climate control system for an indoor space. In an embodiment, the method includes determining an enthalpy of the indoor space. In addition, the method includes detecting a coil temperature of the heat exchanger. Further, the method includes detecting a coil temperature deviation based on the enthalpy and the detected coil temperature.

Still other embodiments disclosed herein are directed a to non-transitory machine-readable medium including instructions that, when executed by a processor, cause the processor to: determine an enthalpy of the indoor space, detect a coil temperature of the heat exchanger, and detect a coil temperature deviation based on the enthalpy and the detected coil temperature.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
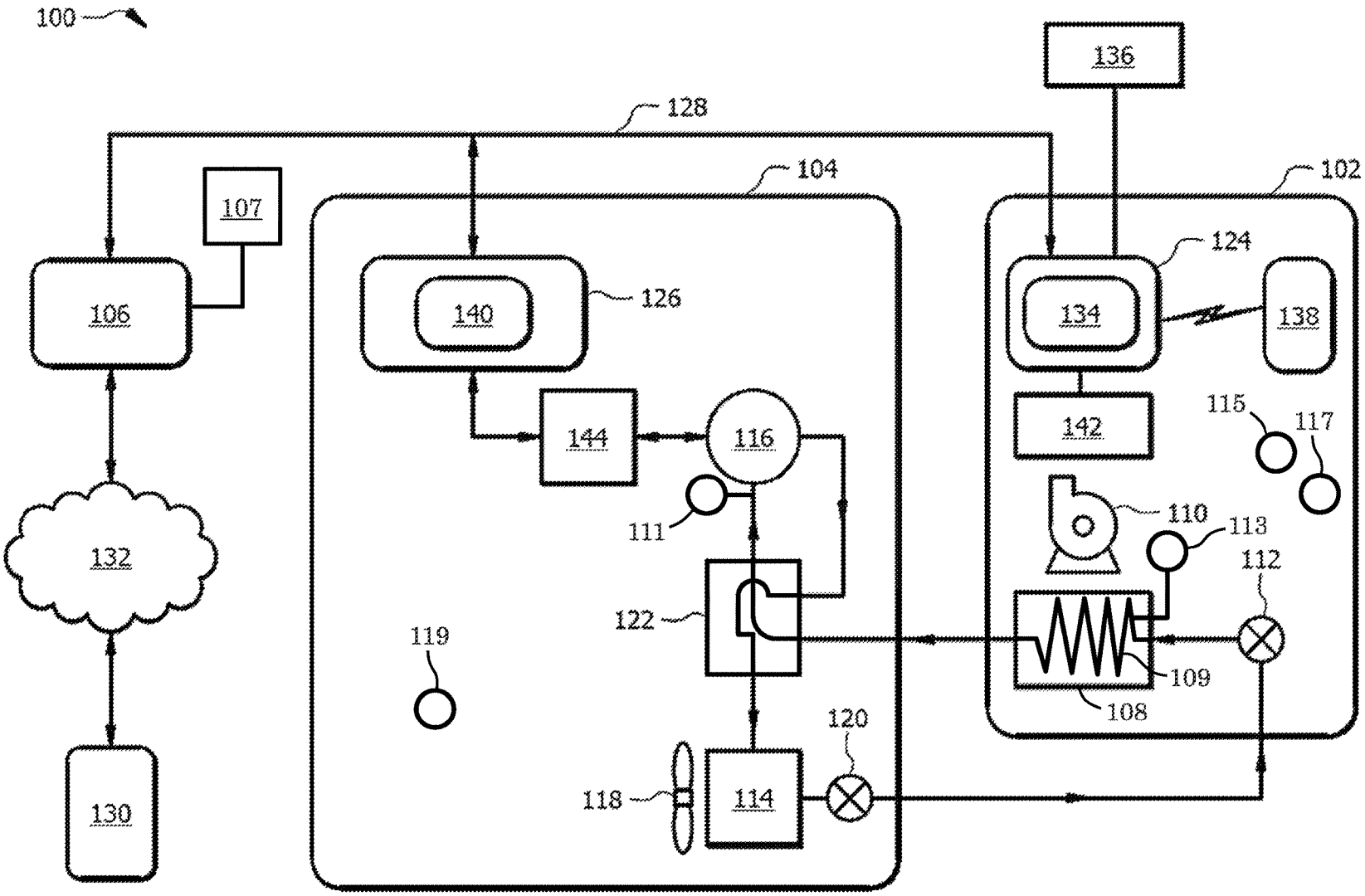
FIG. 1 is a diagram of a HVAC system configured for operating in a cooling mode according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As previously described above, a climate control system that is operating to cool an indoor space may experience operating difficulties or problems (e.g., such as ice formation on the indoor coils, insufficient cooling, etc.) when a temperature of a heat exchanger coil of the climate control system deviates from what may be expected during normal operation. There are a number of potential causes of problems that may result in such a coil temperature deviation. For instance, an air flow across the heat exchanger coil and/or an amount of refrigerant flowing through the coil may be insufficient. As another example, a controller of the climate control system may be faulty. Regardless of the particular cause of the coil temperature deviation, one may wish to identify the deviation so that correction or repairs may take place before system performance is effected and/or damage occurs. Accordingly, embodiments disclosed herein include systems and methods for detecting a coil temperature deviation of a heat exchanger coil of a climate control system. In some embodiments, the disclosed systems and methods may determine a coil temperature deviation so as to inform a system owner, a technician, a controller, etc. and allow corrective action to be taken before a failure or other negative consequence should occur (e.g., such as a coil freeze, reduced cooling performance, etc.).

As used herein a "coil temperature deviation" refers to a condition of a climate control system wherein the temperature of a heat exchanger coil (e.g., such as a coil of an indoor heat exchanger) within the climate control system is significantly different from what may be expected during normal, steady-state operations. In some embodiments, a coil temperature deviation may occur when a difference between a detected or measured coil temperature and an expected or designed coil temperature is greater than a predetermined threshold. As will be described in more detail below, the predetermined threshold may be set so as to distinguish system fluctuations or coil temperature from a coil temperature deviation as defined above.

As used herein, the "coil temperature" of a heat exchanger of a climate control system refers to a temperature of a coil that channels refrigerant within the heat exchanger during operations. For instance, the coil temperature may comprise the temperature of the material forming the coil. As will be described in more detail below, the coil of a heat exchanger within a climate control system may comprise a thermally conductive material (e.g., a metallic material such as copper, aluminum, etc.) so that a temperature of the material forming the coil may be the same, close to, or at least related to the temperature of the refrigerant flowing therethrough.

Referring now to FIG. 1, a schematic diagram of a climate control system 100 according to some embodiments is shown. In this embodiment, climate control system 100 is an HVAC system, and thus, system 100 may be referred to herein as HVAC system 100. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. Specifically, indoor heat exchanger 108 may include a coil 109 for channeling the refrigerant therethrough that segregates the refrigerant from any air flowing through indoor heat exchanger 108 during operations. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 (specifically across or over the coil 109) to promote heat transfer between the airflow and a refrigerant flowing through the coil 109 of the indoor heat exchanger 108. The indoor fan 110 may also be configured to deliver temperature-conditioned air from the indoor unit 102 to one or more areas and/or zones of an indoor space. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104, when configured as a heat pump, generally comprises an outdoor heat exchanger 114, a compressor 116, an outdoor fan 118, an outdoor metering device 120, a reversing valve 122, and an outdoor controller 126. It should be appreciated that the reversing valve 122 may not be included in embodiments of HVAC system 100 that are configured as an air conditioner only (i.e., for embodiments of HVAC system 100 that are not configured as a heat pump as described above). In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger. While not specifically shown, it should be appreciated that outdoor heat exchanger 114 may include a coil similar to coil 109 previously described above for indoor heat exchanger 108.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In some embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate, directly or indirectly, with a plurality of sensors associated with components of the indoor unit 102, the outdoor unit 104, etc. The sensors may measure or detect a variety of parameters, such as, for example, pressure, temperature, and flow rate of the refrigerant as well as pressure and temperature of other components or fluids of or associated with HVAC system 100. For instance, in some embodiments, the system controller 106 may comprise a temperature sensor and/or may further be configured to control heating and/or cooling of zones associated with the HVAC system 100 (e.g., within the indoor space). In some embodiments, the system controller 106 may be configured as a thermostat, having a temperature sensor and a user interface, for controlling the supply of conditioned air to zones associated within the HVAC system 100.

In some embodiments, HVAC system 100 may include a pressure sensor 111 configured to sense or detect a pressure of the refrigerant at the suction side of compressor 116. In addition, HVAC system 100 may include a temperature sensor 113 configured to sense or detect a temperature of the coil 109 of the indoor heat exchanger 108. In some embodiments, the temperature of the coil 109 in indoor heat exchanger 108 (e.g., the temperature measured by sensor 113) may comprise the external temperature of the coil 109 (or an external temperature of a fluid manifold of the indoor heat exchanger 108 that is fluidly coupled to the coil 109), the temperature of the refrigerant flowing through the coil 109, or a combination thereof. In some embodiments, the material forming the coil 109 may be thermally conductive, so that a temperature of the refrigerant flowing within the coil 109 may be the same, substantially the same, or relatively close to the temperature of the coil 109 itself. Each of the sensors 111, 113 may be coupled to system controller 106 (e.g., either directly or through one of the indoor controller 124 and outdoor controller 126) through a suitable communication path (which may be any suitable wired communication path, wireless communication path, or a combination thereof).

In some embodiments, a temperature sensor 113 may be arranged to measure a temperature of a portion of the coil 109 that may be most prone or susceptible to ice formation during operation of the HVAC system 100 in the cooling mode as described in more detail below. For instance, a portion of the coil 109 at or near the inlet of the indoor heat exchanger 108 may operate at relatively colder temperatures during cooling mode operation (e.g., due to the close proximity to the indoor metering device 112). Thus, in some embodiments, temperature sensor 113 may sense or detect the coil temperature at or near this location because it may reach an ice formation temperature (e.g., at or below 32° F.) before the other portions of coil 109 during operations.

In addition, in some embodiments, HVAC system 100 may include a humidity sensor 115 and a temperature sensor 117 for sensing or detecting a humidity (e.g., a relative humidity) and temperature (e.g., dry bulb temperature), respectively, of the indoor space that is being climate controlled by the HVAC system 100. Also, HVAC system 100 may include a temperature sensor 119 for sensing or detecting a temperature (e.g., a dry bulb temperature) of the outdoor space outside of the indoor space (e.g., which may be referred to herein as the outdoor ambient temperature). In some embodiments, the humidity sensor 115 and temperature sensor 117 may be incorporated with a user interface located within the indoor space, and the temperature sensor 119 may be incorporated or located within the outdoor unit 104, but other locations and arrangements for humidity sensor 115 and temperature sensors 117, 119 are possible. As was previously described above for the sensors 111, 113, humidity sensor 115 and temperature sensors 117, 119 may be coupled to system controller 106 (e.g., either directly or through one of the indoor controller 124 and outdoor controller 126) through a suitable communication path (which may be any suitable wired communication path, wireless communication path, or a combination thereof).

The system controller 106 may also be in communication with an input/output (I/O) unit 107 (e.g., a graphical user interface, a touchscreen interface, or the like) for displaying information and for receiving user inputs. The I/O unit 107 may display information related to the operation of the HVAC system 100 (e.g., from system controller 106) and may receive user inputs related to operation of the HVAC system 100. During operations, I/O unit 107 may communicate received user inputs to the system controller 106, which may then execute control of HVAC system 100 accordingly. Communication between the I/O unit 107 and system controller 106 may be wired, wireless, or a combination thereof. In some embodiments, the I/O unit 107 may further be operable to display information and receive user inputs tangentially and/or unrelated to operation of the HVAC system 100. In some embodiments, however, the I/O unit 107 may not comprise a display and may derive all information from inputs from remote sensors and remote configuration tools (e.g., remote computers, servers, smartphones, tablets, etc.). In some embodiments, system controller 106 may receive user inputs from remote configuration tools, and may further communicate information relating to HVAC system 100 to I/O unit 107. In these embodiments, system controller 106 may or may not also receive user inputs via I/O unit 107.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device(s) 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the other device 130 may also comprise a remote server.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

System controller 106, indoor controller 124, and outdoor controller 126 (as well as compressor drive controller 144, indoor fan controller 142, indoor EEV controller 138, etc.) may each comprise any suitable device or assembly which is capable of receiving electrical (or other data) signals and transmitting electrical (or other data) signals to other devices. In particular, while not specifically shown, system controller 106, indoor controller 124, and outdoor controller 126 (as well as controllers 138, 142, 144, etc.) may each include a processor and a memory. The processors (e.g., microprocessor, central processing unit, or collection of such processor devices, etc.) may execute machine readable instructions (e.g., non-transitory machine readable medium) provided on the corresponding memory to provide the processor with all of the functionality described herein. The memory of each controller 106, 124, 126 may comprise volatile storage (e.g., random access memory), non-volatile storage (e.g., flash storage, read only memory, etc.), or combinations of both volatile and non-volatile storage. Data consumed or produced by the machine readable instructions can also be stored on the memory of controllers 106, 124, 126.

During operations, system controller 106 may generally control the operation of HVAC system 100 through the indoor controller 124 and outdoor controller 126 (e.g., via communication bus 128), and may monitor the operational parameters of the HVAC system 100. In the description below, specific methods are described (e.g., method 200). It should be understood that the features of these described methods may be performed (e.g., wholly or partially) by system controller 106, or by one or more of the indoor controller 124, and outdoor controller 126 as directed by system controller 106. As a result, the controller or controllers of HVAC system 100 (e.g., controllers 106, 124, 126, 142, 144, 138, etc.) may include and execute machine-readable instructions (e.g., non-volatile machine readable instructions) for performing the operations and methods described in more detail below. In some embodiments, each of the controllers 106, 124, 126 may be embodied in a singular control unit, or may be dispersed throughout the individual controllers 106, 124, 126 as described above.

In addition, the methods described below may also be performed (e.g., wholly or partially) by a separate controller (e.g., such as device 130 shown in FIG. 1). For instance, in some embodiments, the methods described below comprise methods of detecting a coil temperature deviation for a heat exchanger of a climate control system (e.g., such as HVAC system 100). In some embodiments, these methods may be performed by a remote device (e.g., such as a remote server or computer) that may generally be referred to herein as a remote controller. For instance, a remote controller may perform one or more of the steps of the method so as to provide a system operator, a technician, or other individual (who may be remotely located relative to the climate control system and/or the indoor space associated therewith) of the coil temperature deviation.

As shown in FIG. 1, the HVAC system 100 is configured for operating in a so-called cooling mode in which heat may generally be absorbed by refrigerant at the indoor heat exchanger 108 and rejected from the refrigerant at the outdoor heat exchanger 114. Starting at the compressor 116, the compressor 116 may be operated to compress refrigerant and pump the relatively high temperature and high pressure compressed refrigerant through the reversing valve 122 and to the outdoor heat exchanger 114, where the refrigerant may transfer heat to an airflow that is passed through and/or into contact with the outdoor heat exchanger 114 by the outdoor fan 118. After exiting the outdoor heat exchanger 114, the refrigerant may flow through and/or bypass the outdoor metering device 120, such that refrigerant flow is not substantially restricted by the outdoor metering device 120. Refrigerant generally exits the outdoor metering device 120 and flows to the indoor metering device 112, which may meter the flow of refrigerant through the indoor metering device 112, such that the refrigerant downstream of the indoor metering device 112 is at a lower pressure than the refrigerant upstream of the indoor metering device 112. From the indoor metering device 112, the refrigerant may enter the indoor heat exchanger 108. As the refrigerant is passed through coil 109 of the indoor heat exchanger 108, heat may be transferred to the refrigerant from an airflow that is passed through and/or into contact with the indoor heat exchanger 108 by the indoor fan 110. Refrigerant leaving the indoor heat exchanger 108 may flow to the reversing valve 122, where the reversing valve 122 may be selectively configured to divert the refrigerant back to the compressor 116, where the refrigeration cycle may begin again.

During operation of the HVAC system 100 in the above-described cooling mode, a coil temperature deviation may occur such that a temperature of the coil 109 within indoor heat exchanger 108 may be significantly different from an expected or designed coil temperature during steady-state operations. As previously described above, when the HVAC system 100 is operating in the cooling mode, a coil temperature deviation within the coil 109 of indoor heat exchanger 108 may result in a temperature of coil 109 being lower than an expected value during operations. Such a coil temperature deviation may occur within HVAC system 100 for a number of different reasons. For instance, without being limited to this or any other theory, a coil temperature deviation may occur within indoor heat exchanger 108 as a result of insufficient air flow across the heat exchanger coil 109 from indoor fan 110 or because of an insufficient amount of refrigerant flowing within the heat exchanger coil 109.

As an example, if airflow across the coil 109 is too low, less enthalpy may be transferred to the refrigerant flowing within coil 109, such that the operating temperature of the coil 109 may be reduced below that expected for normal operations. As another example, if an amount or charge of refrigerant flowing within coil 109 of indoor heat exchanger 108 is too low, the refrigerant may over expand when flowing through the indoor metering device 112 so that a temperature of the refrigerant may fall below that expected for the coil 109 for normal, steady-state operations. If the temperature reduction in the coil 109 is significant enough, ice may form on the outer surface of the coil 109, thereby restricting or preventing indoor heat exchanger 108 from cooling the air flowing within the indoor space, and potentially damaging other components within HVAC system 100 (e.g., such as compressor 116 as previously described above).

Often, a coil temperature deviation may go un-noticed until coil freezing or system damage occurs. As a result, the systems and methods described herein may allow a coil temperature deviation to be identified relatively early, so that appropriate corrective action may be taken (e.g., by a system owner, operator, technician, etc.) before system damage or performance reduction occurs. As will be described in more detail herein, the disclosed systems and methods may identify a coil temperature deviation based (at least partially) on an enthalpy of the indoor space.

Figure 2:
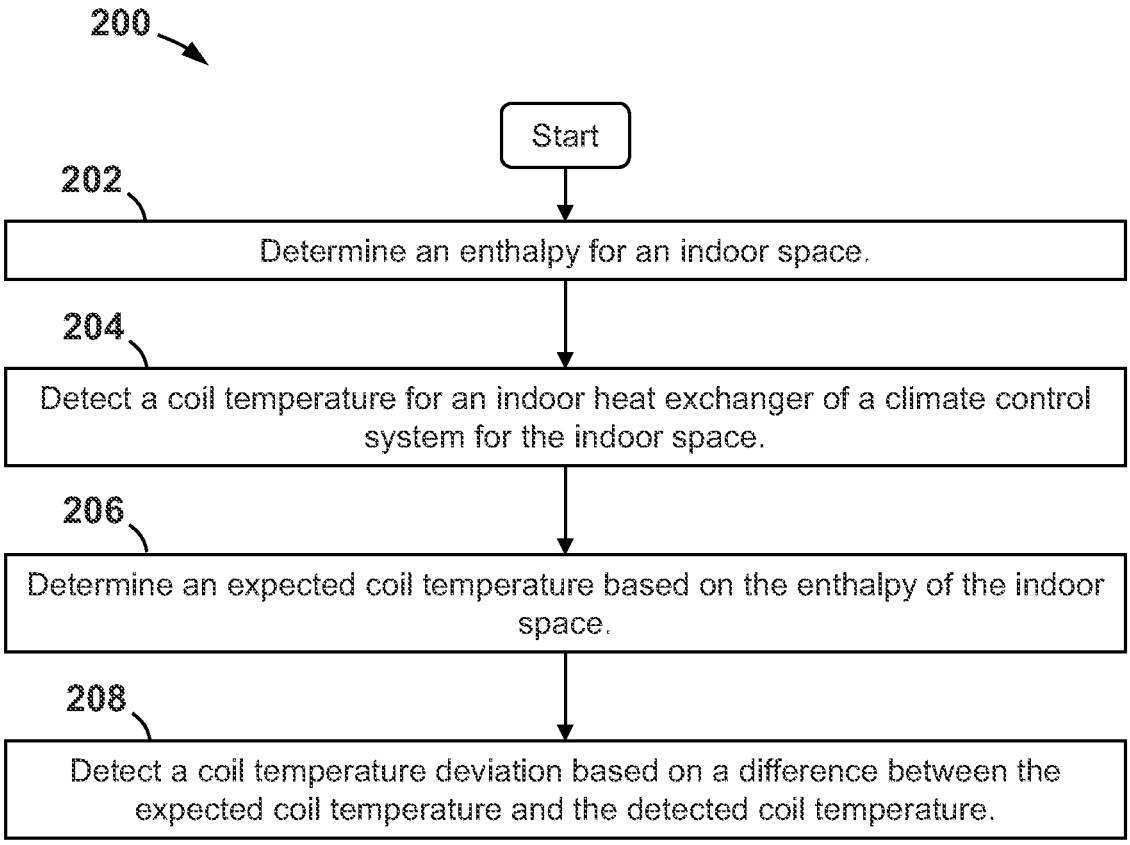
FIG. 2 is a flow chart of a method of detecting a coil temperature deviation for a heat exchanger of a climate control system according to some embodiments.

Referring now to FIG. 2, a method 200 of detecting a temperature deviation in a heat exchanger coil of a climate control system for an indoor space (e.g., such as a residential dwelling, office space, etc.) is shown. In some embodiments, method 200 may be practiced with HVAC system 100, while HVAC system 100 is being operated in the cooling mode as previously described above (see e.g., FIG. 1). Thus, in describing the features of method 200, continuing reference will made to the HVAC system 100 shown in FIG. 1;

however, it should be appreciated that embodiments of method 200 may be practiced with other systems, assemblies, and devices (e.g., such as other climate control systems).

Initially, method 200 includes determining an enthalpy of an indoor space at 202. Enthalpy may be a thermodynamic value or quantity that represents the total heat content of a space or system. Thus, the enthalpy of the indoor space may be a measure or representative value of the heat content in the indoor space. The enthalpy within the indoor space may be determined, calculated, inferred, or derived based on a variety of different methods and/or information. For instance, in some embodiments, the enthalpy of the indoor space may be determined based on the relative humidity and temperature of the indoor space. For the HVAC system 100 of FIG. 1, the indoor relative humidity and indoor temperature may be obtained from the sensors 115, 117 as previously described above. In particular, in some embodiments, once the values of the indoor relative humidity and temperature are determined or obtained, the enthalpy of the indoor space may be determined using the following relationship:

$$H = 0.24 \times TK_{Indoor} + \left[\frac{(0.62198 \times RH \times e^{A})}{P_{atm} - RH \times e^{A}}\right] \times (1061 + 0.44 \times T_{indoor}), \quad (1)$$

wherein H is the enthalpy of the indoor space, $TK_{Indoor}$, $T_{Indoor}$, and RH are the temperature (in Kelvin), the temperature (in degrees Fahrenheit), and the relative humidity (in decimal), respectively, within the indoor space, and wherein A comprises the following relationship:

$$A = \left(\frac{-10440.397}{T_{Indoor}}\right) - 11.29465 - 0.027022355 \times TK_{Indoor} + 0.00001289036 \times TK_{Indoor}^{2} - 0.0000000024780681 \times TK_{Indoor}^{3} + 6.5459673 \times \ln(TK_{Indoor}). \quad (2)$$

In addition, method 200 includes detecting a coil temperature for a heat exchanger of the climate control system at 204. When method 200 is applied to HVAC system 100 operating in the cooling mode, block 204 may comprise detecting a temperature of coil 109 of indoor heat exchanger 108. The coil temperature may be directly or indirectly measured, detected, estimated, or inferred at 204. Specifically, referring briefly again to FIG. 1, in some embodiments, the temperature of the coil 109 may be measured at 204 with the temperature sensor 113 as previously described. In addition, the coil temperature may be detected at a point or along a portion that may be prone or susceptible to ice formation as previously described above.

Alternatively, in some embodiments the current temperature of coil 109 may be indirectly measured or estimated from other measured values or parameters at 204. For instance, in some embodiments, a pressure of the refrigerant may be measured or detected at any suitable location within HVAC system 100 (e.g., within outdoor unit 104, indoor unit 102, etc.), and then the temperature of coil 109 may then be calculated or estimated based on known relationships and variables. Specifically, in some embodiments, pressure sensor 111 may measure a pressure of the refrigerant at the suction side of compressor 116. This measured pressure may be converted (e.g., via a look up table or suitable calculation, etc.) into a saturated suction temperature (SST) of the refrigerant at the measured pressure. As used herein, "saturation suction temperature" refers to the temperature at which the refrigerant boils/vaporizes within the evaporator coils for a given pressure. Thus, a derived value for SST may not reflect the actual temperature of the refrigerant at the suction of the compressor 116, but instead reflects the approximate phase change temperature of the refrigerant (e.g., vaporization temperature) at the measured pressure (e.g., as measured by sensor 111). During operation of HVAC system 100 in the above described "cooling mode," the refrigerant is to change phase from liquid to a vapor as it absorbs heat energy from the air flowing across the coil 109. Thus, while the refrigerant is in the coil 109, it remains at (or substantially at) the vaporization temperature until all (or again substantially all) of the liquid refrigerant has vaporized. Thereafter, the refrigerant begins to increase in temperature above the vaporization temperature as additional heat energy is absorbed from the air flowing across the coil 109. This additional temperature increase is typically referred to as "superheat." Thus, the SST value of the refrigerant (which may be derived from the pressure of the refrigerant at the suction of compressor 116 via sensor 111 as previously described above), may provide the temperature of the refrigerant while it was flowing through the coil 109 (or during a majority of the time the refrigerant was flowing through the coil 109).

However, it should be noted that the pressure of the refrigerant at the suction side of the compressor 116 (e.g., the pressure measured by sensor 111) may be slightly lower than the pressure of the refrigerant within coil 109. This is driven by a number of factors (e.g., the length of the flow path between the coils, the relative diameters of flow paths within HVAC system 100, etc.). As a result, the derived value of SST may be less than the actual vaporization temperature of the refrigerant when it was flowing within the coil 109 (i.e., the coil temperature). Therefore, in some embodiments, an offset may be applied to the derived value of SST based on a known (or estimated) pressure difference of the refrigerant between coil 109 and compressor 116 to thereby give the coil temperature. In some embodiments, the offset between SST and the final coil temperature may be 5° F. or less, such as, for instance 3° F. or less, or 2° F. or less, etc.

In some embodiments, the coil temperature detection at block 204 may be performed when the climate control system has reached a steady-state operation. In particular, for the HVAC system 100 in FIG. 1, during an initial start-up period for the cooling mode operation described above, the temperature of the coil 109 may be changing rapidly as it cools from an initial temperature (e.g., an ambient temperature) to a final, steady-state temperature. Accordingly, by limiting coil temperature detection (e.g., such as at block 204) to operational periods associated with steady-state operation, coil temperature deviations may be distinguished from coil temperature fluctuations that may be associated with a start-up period for the climate control system. Thus, in some embodiments method 200 may also comprise determining that the climate control system (and particularly the coil temperature of the indoor heat exchanger 108) has reached a steady state before performing one or more of the blocks 202-208 as described above. In some embodiments, determining that the climate control system has reached a steady-state may comprise taking successive measurements of the coil temperature (e.g., via any of the methods previously described above), and determining that steady state has been achieved when a difference between successive coil temperatures is within a predetermined threshold value. In some embodiments, determining that the climate control system has reached a steady-state may comprise waiting to take a coil temperature reading or measurement until a predetermined amount of time (e.g., 10 minutes, 5 minutes, 2 minutes, etc.) has passed since startup.

In some embodiments, a plurality of measurements of the indoor coil temperature may be taken at block 204 while the climate control system is operating. For instance, a plurality of coil temperature readings may be taken at regular intervals (e.g., every 10 minutes, 5 minutes, 2 minutes, etc.) while the climate control system is operating). The lowest temperature measured of the plurality of measurements may then be compared to an expected coil temperature at block 208 to determine whether a coil temperature deviation is occurring as previously described above.

Referring again to FIG. 2, method 200 generally also includes determining an expected coil temperature based on the enthalpy of the indoor space at 206. The expected coil temperature may be determined via a number of different methods and by utilizing a number of different variables or values. Each of the chosen methods may provide different levels of accuracy, but may also call for additional sensors or analysis within the climate control system. Thus, one having ordinary skill may choose which method may be appropriate given the overall circumstances.

For instance, in some embodiments, the expected coil temperature at 206 may be determined solely by the enthalpy of the indoor space. Specifically, in some embodiments, the expected coil temperature (CT) may be determined via the following relationship:

$$CT=aH^2+bH-c \quad (3),$$

wherein H is the enthalpy of the indoor space, and a, b, and c are constant values. The constant values of a, b, c may depend upon the specific design and parameters of the climate control system (e.g., such as the size, type, model, etc. of the indoor unit 102, outdoor unit 104, type of refrigerant, etc. within HVAC system 100). Thus, the specific values of a, b, and c may be empirically or experimentally derived, calculated, estimated, inferred, etc. for the specific climate control system that method 200 is being practiced with (e.g., such as HVAC system 100).

In some embodiments, the expected coil temperature may be determined at 206 based on the enthalpy as well as other values or parameters. For instance, in some embodiments, the expected coil temperature may be determined at 206 based on the enthalpy of the indoor space as well as the cooling capacity of the climate control system. The cooling capacity of a climate control system may be a value that represents a rate of heat energy that may be removed (i.e., a rate of cooling) for a certain indoor space. In some embodiments, the cooling capacity of a climate control system may be represented in "Tons," wherein one "Ton" of cooling capacity may be equivalent or 12,000 British Thermal Units (BTUs) per hour. Thus, the cooling capacity of a climate control system (e.g., such as HVAC system 100) may be directly relevant to an expected temperature of the indoor heat exchanger coils (e.g., such as coil 109) during operation. Accordingly, in some embodiments, determining the expected coil temperature at 206 may comprise calculating a correction offset for the expected coil temperature based on the cooling capacity of the climate control system to produce a corrected, expected coil temperature. For instance, in some embodiments, the corrected, expected coil temperature ($CT_{Corrected}$) may be determined via the following relationship:

$$CT_{Corrected}=-dT+e+CT \quad (4),$$

wherein T is the cooling capacity of the climate control system in Tons, CT is an expected coil temperature, and d and e are constant values. The constant values d and e may depend upon the specific design and parameters of the climate control system (e.g., such as the size, type, model, etc. of the indoor unit 102, outdoor unit 104, type of refrigerant, etc. within HVAC system 100). Thus, the constant values of d and e may be derived in a generally similar fashion as that described above for the constant values of Equation (3) (e.g., values a, b, and c). In addition, the value of CT in Equation (4) may be determined via any suitable method or relationship. For instance, in some embodiments the value of CT in Equation (4) may be determined via Equation (3) or Equation (5) described in more detail below. Thus, in Equation (4), the relationship "−dT+e" may comprise a first offset for the expected coil temperature that is based on the cooling capacity of the associated climate control system.

In some embodiments, the expected coil temperature may be determined at block 206 based on the enthalpy of the indoor space, the capacity of the climate control system, and the outdoor temperature. For the HVAC system 100 operating in a cooling mode as described above, once the refrigerant is emitted from the indoor heat exchanger 108, it is routed to through the outdoor heat exchanger 114 so as to exchange heat with the outdoor environment. Thereafter, the refrigerant may once again flow through compressor 116 and advance again toward the indoor heat exchanger 108. As a result, the temperature of the outdoor environment may have an effect on the expected operating temperature of the coil 109 of the indoor heat exchanger 108. Thus, in some embodiments, the expected coil temperature determined at block 206 of method 200 may include an offset for the outdoor temperature.

For instance, in some embodiments method 200 may additionally include determining the outdoor temperature, and then determining the expected coil temperature based on the enthalpy of the indoor space, and the outdoor temperature at block 206. The outdoor temperature may be determined via a suitable sensor (e.g., such as outdoor temperature sensor 119 in HVAC system 100). However, in some embodiments, the outdoor temperature may be provided by a number of other sources (e.g., such as a remotely disposed sensor that is not incorporated within the climate control system). Regardless, once a value for the outdoor temperature is obtained, a suitable correction offset may be applied to the expected coil temperature based on the outdoor temperature to produce a corrected, expected coil temperature. Specifically, in some embodiments, the corrected, expected coil temperature ($CT_{Corrected}$) may be determined via the following relationship:

$$CT_{Corrected}=CT+sT_O-f \quad (5),$$

wherein CT is an expected coil temperature determined via Equation (4) or Equation (3) (or any other suitable method or relationship), $T_O$ is the outdoor temperature (in degrees Fahrenheit), and s and f are constant values. The constant values s and f may depend upon the specific design and parameters of the climate control system (e.g., such as the size, type, model, etc. of the indoor unit 102, outdoor unit 104, type of refrigerant, etc. within HVAC system 100). Thus, the constant values of s and f may be derived in a generally similar fashion as described above for the constant values of Equation (3) (e.g., values a, b, c). Thus, in Equation (5), the relationship "$sT_O-f$" may comprise a second offset for the expected coil temperature that is based on the outdoor temperature.

As described above, each of the above described relationships and methods of determining an expected coil temperature at block 206 have been at least partially dependent or based upon the determined enthalpy of the indoor space. Thus, determining the expected coil temperature via any of the relationships discussed above for Equations (3), (4), or (5) may be referred to herein as determining the expected coil temperature based on the enthalpy of the indoor space.

Next, once the detected coil temperature and the expected coil temperature are obtained at blocks 204 and 206, respectively, method 200 proceeds to detect a coil temperature deviation based on a difference between the detected coil temperature and the expected coil temperature at 208. In some embodiments, the difference between the expected coil temperature and detected coil temperature is compared to a predetermined threshold, and if the determined difference is greater than or equal to the threshold, then a determination is made that a coil temperature deviation has occurred. On the other hand, if the determined difference is less than the threshold, then a determination is made that a coil temperature deviation has not occurred. In this latter circumstance (i.e., where the difference between the expected coil temperature and the detected coil temperature is less than the predetermined threshold), the difference may be small or minor enough such that it may be accounted for by rounding errors, measurement device variations, normal system variations, etc.

In some embodiments, the predetermined threshold value for the difference between the expected coil temperature and the detected coil temperature may correspond with a predetermined deviation from the expected coil temperature. In particular, in some embodiments, the predetermined threshold may correspond with a 5% deviation from the expected coil temperature; however, other specific values are possible in other embodiments.

As previously described above, a coil temperature deviation may occur as a result of an insufficient air flow across the coil of the indoor heat exchanger (e.g., such as across the coil 109 of indoor heat exchanger 108 of FIG. 1) and/or as a result of a low amount of refrigerant flowing within the coil (e.g., such as if a leak of refrigerant has occurred or if the refrigerant was not properly charged the designed level). Thus, a determination at 208 that a coil temperature deviation has occurred at 208 may prompt further analysis or investigation by an operating, technician, controller, etc. as to the flow rate of air within the indoor heat exchanger and/or the current charge or level of refrigerant within the system. For instance, further investigation may reveal that one or more air filters within the climate control system (e.g., HVAC system 100) are clogged, thereby reducing an air flow across the coil of the indoor heat exchanger and causing the coil temperature deviation detected at 208. In another example, further investigation may reveal that the charge of the refrigerant within the climate control system is low (e.g., due to a leak or mistake), thereby causing the coil temperature deviation detected at 208.

In some embodiments, method 200 may further include performing a corrective action to address the detected coil temperature deviation so as to prevent system damage. For instance, in some embodiments, a corrective action (or several corrective actions) may be automatically performed by a controller (e.g., system controller 106) in response to the detection of a coil temperature deviation at 208.

In some embodiments, a corrective action may include a change in one or more operating parameters of the climate control system so as to raise a temperature of the coil so as to avoid ice formation. For instance, for the HVAC system 100 such corrective actions may include increasing a speed of indoor fan 110 and/or decreasing a speed of compressor 116. In some embodiments, a corrective action may also include shutting down the HVAC system 100 entirely.

In some embodiments, a plurality of successive corrective actions may be performed following the detection of a coil temperature deviation at block 208. In particular, method 200 may include initiating a series of actions or steps designed to increase a temperature of the indoor heat exchanger coil 109 to avoid or reduce ice formation. In some embodiments, method 200 may include assessing the effectiveness of each performed corrective action before moving on to a subsequent corrective action. For instance, upon detecting a coil temperature deviation at block 208, method 200 may include increasing an indoor fan speed (e.g., indoor fan 110). If this action does not reduce a difference between the expected coil temperature and the detected coil temperature, method 200 may perform additional, successive increases in the fan speed until a limit is reached (e.g., a mechanical operating limit). If further corrective actions are still called for, a speed of the refrigerant compressor (e.g., compressor 116) may then be decreased (e.g., in successive steps until a lower limit is reached), and then finally, the climate control system may be shut down. After each corrective action, additional measurements of the indoor heat exchanger coil may be taken so as to determine whether the corrective action sufficiently raised the coil temperature to avoid ice formation.

In some embodiments, the performance of corrective action may be conditioned upon a difference between the detected and expected coil temperatures being greater than a second or corrective action threshold. The corrective action threshold value may be the same or greater than the predetermined threshold to determine whether a coil temperature deviation exists at block 208 as described above.

Thus, through use of the systems and methods described herein (e.g., HVAC system 100, method 200, etc.), a coil temperature deviation may be detected for a heat exchanger coil (e.g., coil 109 of indoor heat exchanger 108) of a climate control system. In some embodiments, the disclosed systems and methods may determine a coil temperature deviation so as to inform a system owner, a technician, a controller, etc. and allow corrective action to be taken before a failure or other negative consequence should occur (e.g., such as a coil freeze, reduced cooling performance, etc.). Accordingly, through use of the systems and methods described herein, an operating life of a climate control system and/or components thereof may be increased.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A processor coupled to a climate control system, the processor including a non-transitory machine-readable medium including instructions that, when executed by the processor, cause the processor to:

determine an enthalpy of the indoor space based on a relative humidity of the indoor space and an indoor temperature of the indoor space;

determine an expected coil temperature based on the enthalpy of the indoor space;

receive a measurement indicative of a coil temperature of a heat exchanger;

determine a coil temperature deviation based on the expected coil temperature and the detected coil temperature;

compare the coil temperature deviation to a predetermined threshold value; and instruct the climate control system to perform a corrective action based on the comparison of the coil temperature deviation and the predetermined threshold value.

2. The processor of claim 1, wherein the processor further includes instructions, when executed by the processor coupled to the climate control system, cause the processor to determine the heat exchanger coil is prone to ice formation based on the comparison of the coil temperature deviation and the predetermined threshold value, and wherein taking the corrective action based on the comparison further includes taking corrective action based on the determination the heat exchanger coil is prone to ice formation.

3. The processor of claim 1, wherein the corrective action includes sending a signal to display an indication that ice formation is likely to occur.

4. The processor of claim 1, wherein the corrective action includes sending a signal to display an indication of reduced cooling performance.

5. The processor of claim 1, wherein the corrective action includes one of either adjusting a speed of air flowing over the heat exchanger coil or a speed of a compressor providing refrigerant through the heat exchanger coil.

6. The processor of claim 1, wherein the processor is further coupled to a humidity sensor that provides measurements of the humidity of the indoor space, a temperature sensor that provides measurements of the indoor temperature of the indoor space, and a temperature sensor that provides the measurements indicative of the coil temperature of the heat exchanger.

7. The processor of claim 1, wherein the processor further includes instructions, when executed by the processor coupled to the climate control system, cause the processor to determine the expected coil temperature by setting the expected coil temperature equal to the following expression: $aH^{2+}$ bH−c, wherein H is the enthalpy of the indoor space, and a, b, and c are constant values.

8. The processor of claim 1, wherein the processor further includes instructions, when executed by the processor coupled to the climate control system, cause the processor to determine an offset for the expected coil temperature by setting the offset equal to the following expression: −dT+e, wherein T is a cooling capacity of the climate control system, and d and e are constant values.

9. The processor of claim 1, wherein the processor further includes instructions, when executed by the processor coupled to the climate control system, cause the processor to receive measurements indicative of an outdoor temperature, and determine an offset for the expected coil temperature based on the measurements indicative of the outdoor temperature.

10. The processor of claim 9, wherein the offset is determined by setting the offset equal to the following expression: $sT_0-f$, wherein $T_O$ is the outdoor temperature, and s and f are constant values.

11. A remote server coupled to a climate control system via a communication network, the remote server including a processor and a non-transitory machine-readable medium including instructions that, when executed by the processor, cause the processor to:

determine an enthalpy of the indoor space based on a relative humidity of the indoor space and an indoor temperature of the indoor space;

determine an expected coil temperature based on the enthalpy of the indoor space;

receive a measurement indicative of a coil temperature of a heat exchanger;

determine a coil temperature deviation based on the expected coil temperature and the detected coil temperature;

compare the coil temperature deviation to a predetermined threshold value;

determine the heat exchanger coil is prone to ice formation based on the comparison of the coil temperature deviation and the predetermined threshold value; and provide a signal to a remote device, the signal indicating the climate control system needs a corrective action based on the determination the heat exchanger coil is prone to ice formation.

12. The remote server of claim 11, wherein the remote device is a controller of the climate control system.

13. The remote server of claim 11, wherein the remote device is a mobile device, and the signal is further configured to notify a technician that the climate control system needs corrective action.

14. The remote server of claim 11, wherein the processor further includes instructions, when executed by the processor coupled to the climate control system, cause the processor to determine the expected coil temperature by setting the expected coil temperature equal to the following expression: $aH^2+bH-c$, wherein H is the enthalpy of the indoor space, and a, b, and c are constant values.

15. The remote server of claim 11, wherein the processor further includes instructions, when executed by the processor coupled to the climate control system, cause the processor to determine an offset for the expected coil temperature by setting the offset equal to the following expression: −dT+e, wherein T is a cooling capacity of the climate control system, and d and e are constant values.

16. The remote server of claim 11, wherein the processor further includes instructions, when executed by the processor coupled to the climate control system, cause the processor to receive measurements indicative of an outdoor temperature, and determine an offset for the expected coil temperature based on the measurements indicative of the outdoor temperature.

17. The processor of claim 16, wherein the offset is determined by setting the offset equal to the following expression: $sT_0-f$, wherein $T_O$ is the outdoor temperature, and s and f are constant values.

18. A method of preventing ice formation on a heat exchanger coil of a climate control system for an indoor space, the method comprising:

determining an enthalpy of the indoor space based on a relative humidity of the indoor space and an indoor temperature of the indoor space;

determining an expected coil temperature based on the enthalpy of the indoor space;

receiving an indication of a coil temperature of the heat exchanger;

determining a coil temperature deviation based on the expected coil temperature and the detected coil temperature;

comparing the coil temperature deviation to a predetermined threshold value;

determining the heat exchanger coil is prone to ice formation based on the comparison of the coil temperature deviation and the predetermined threshold value indicates; and providing a signal indicating the climate control system needs a corrective action based on the determination the heat exchanger coil is prone to ice formation.

19. The method of claim 18, further comprising notifying a technician that the climate control system needs corrective action.

20. The method of claim 18, wherein determining the expected coil temperature further includes setting the expected coil temperature equal to the following expression: $aH^{2+}$ bH−c, wherein H is the enthalpy of the indoor space, and a, b, and c are constant values.

* * * * *